US007032335B2

(12) United States Patent
Short

(10) Patent No.: US 7,032,335 B2
(45) Date of Patent: Apr. 25, 2006

(54) CONNECTION APPARATUS

(75) Inventor: Bruce Archibald Short, Auckland (NZ)

(73) Assignee: A Ward Attachments, Ltd., Auckland (NZ)

( * ) Notice: Subject to any disclaimer, the term of this patent is extended or adjusted under 35 U.S.C. 154(b) by 360 days.

(21) Appl. No.: 09/987,772

(22) Filed: Nov. 15, 2001
(Under 37 CFR 1.47)

(65) Prior Publication Data

US 2003/0103806 A1 Jun. 5, 2003

Related U.S. Application Data

(63) Continuation of application No. PCT/NZ00/00073, filed on May 15, 2000.

(30) Foreign Application Priority Data

May 15, 1999 (NZ) ..... 332871

(51) Int. Cl.
*E02F 3/96* (2006.01)

(52) U.S. Cl. ..... 37/468; 37/403; 414/723

(58) Field of Classification Search ..... 37/468, 37/403, 409; 172/272–275; 414/723; 403/31, 403/320, 322.3
See application file for complete search history.

(56) References Cited

U.S. PATENT DOCUMENTS 2,963,183 A * 12/1960 Przybylski ..... 414/723
4,881,867 A * 11/1989 Essex et al. ..... 414/723
5,125,788 A * 6/1992 Stenger ..... 414/723
5,350,250 A * 9/1994 Nagler ..... 403/316
5,692,325 A 12/1997 Kuzutani
5,802,753 A * 9/1998 Raunisto ..... 37/468
6,132,130 A * 10/2000 McCann ..... 403/322.1
6,132,131 A * 10/2000 Nakamura et al. ..... 403/322.1
6,233,852 B1 * 5/2001 Pemberton ..... 37/468
6,254,331 B1 * 7/2001 Pisco et al. ..... 414/723
6,379,075 B1 * 4/2002 Shamblin et al. ..... 403/322.1
6,513,268 B1 * 2/2003 Lee et al. ..... 37/468
6,539,650 B1 * 4/2003 Kaczmarski et al. ..... 37/468
6,625,909 B1 * 9/2003 Miller et al. ..... 37/468
6,644,885 B1 * 11/2003 Dam-Rasmussen ..... 403/322.3
6,688,801 B1 * 2/2004 Husson ..... 403/322.1
6,699,001 B1 * 3/2004 Fatemi ..... 414/723

FOREIGN PATENT DOCUMENTS

AU 3562784 5/1985

(Continued)

*Primary Examiner*—Thomas A Beach
(74) *Attorney, Agent, or Firm*—Lowe Hauptman & Berner, LLP

(57) ABSTRACT

An apparatus for connecting an implement to a prime mover, the connection apparatus including a body arranged to be mounted on the prime mover. The body includes a connection device for connecting the body to the implement; the connection device comprising a locking member adapted to move to a first position, in which the locking member engages the implement to lock the implement and the body together, and said locking member also being adapted to move to a second position in which the locking member is disengaged from the implement so that the implement can be demounted from the body.

5 Claims, 8 Drawing Sheets

FOREIGN PATENT DOCUMENTS

| | | | |
|---|---|---|---|
| DE | 29621253 | | 5/1997 |
| DE | 29810750 | | 10/1998 |
| DE | 19806057 | | 9/1999 |
| FR | 2631052 | * | 10/1989 |
| GB | 2205299 | | 12/1988 |
| GB | 2330570 | | 4/1999 |
| GB | 2331064 | | 5/1999 |
| NZ | 250811 | | 6/1997 |
| WO | WO 8802421 | | 4/1988 |
| WO | 91/11565 | * | 5/1988 |

* cited by examiner

FIGURE 2
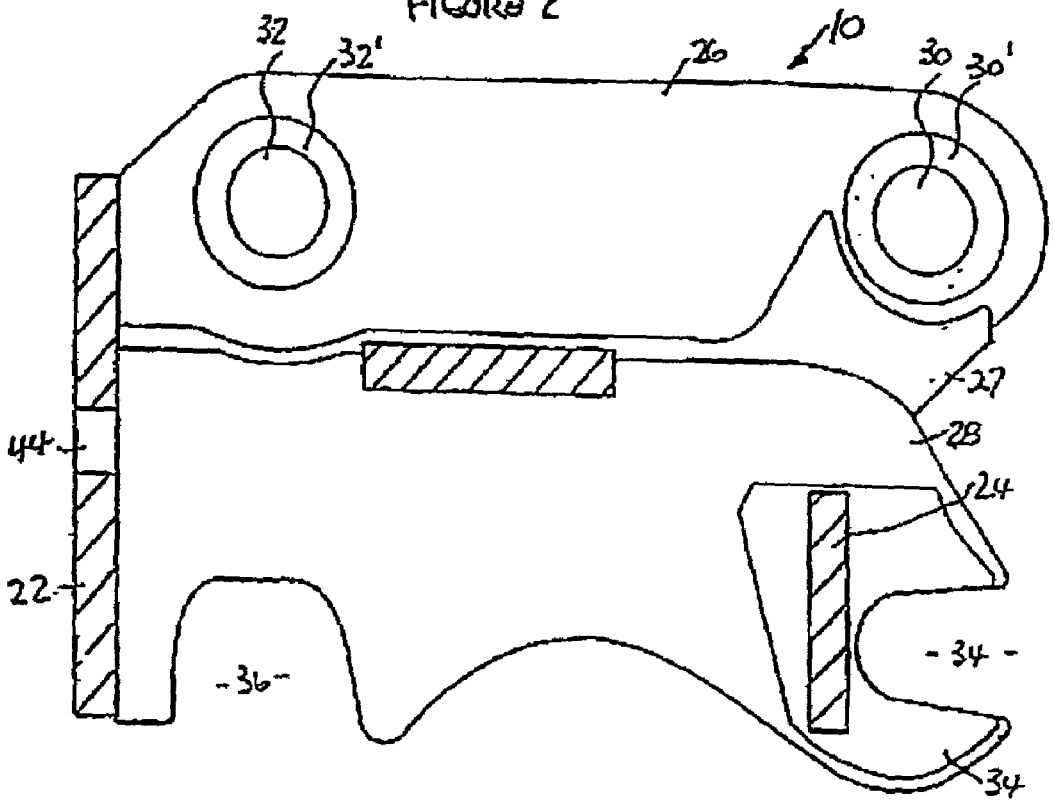
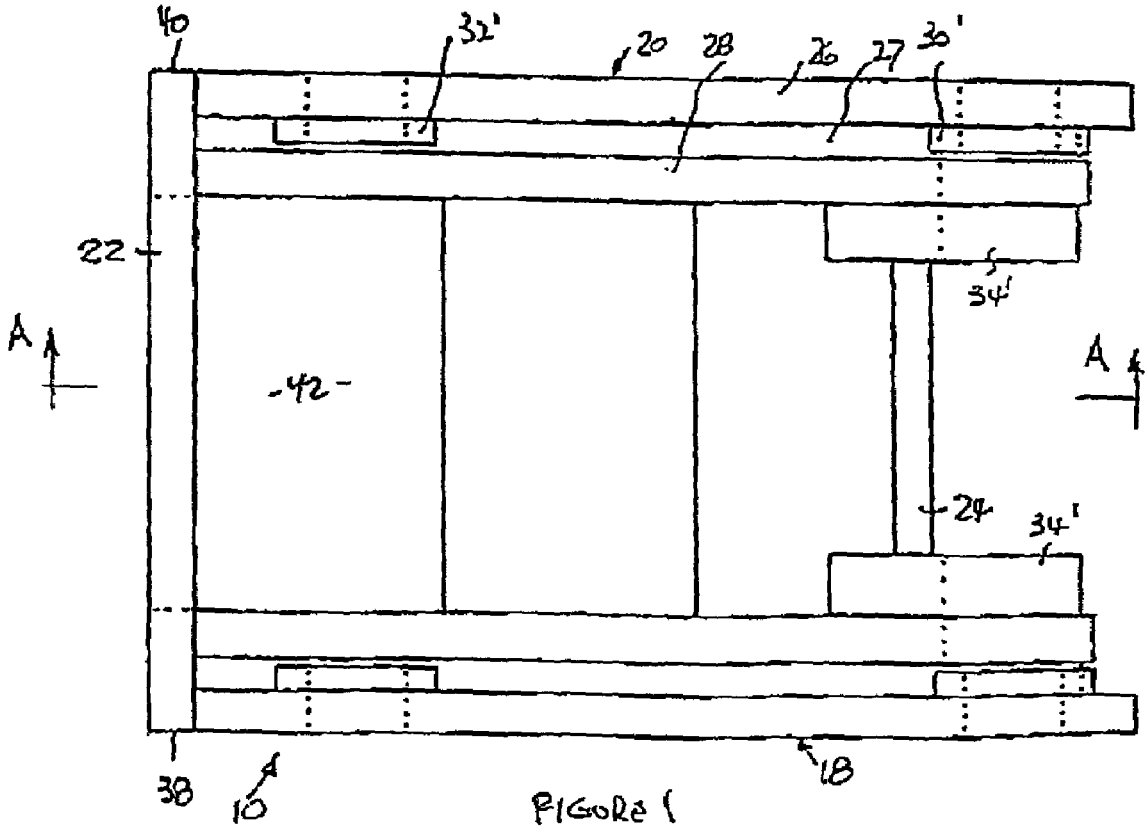
FIGURE 1

FIGURE 4
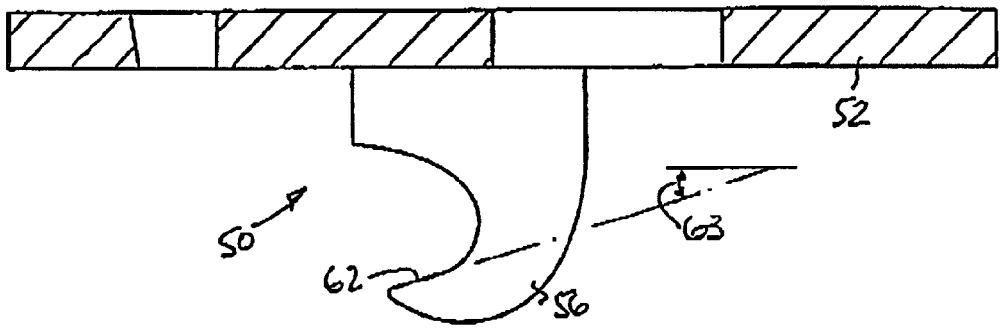
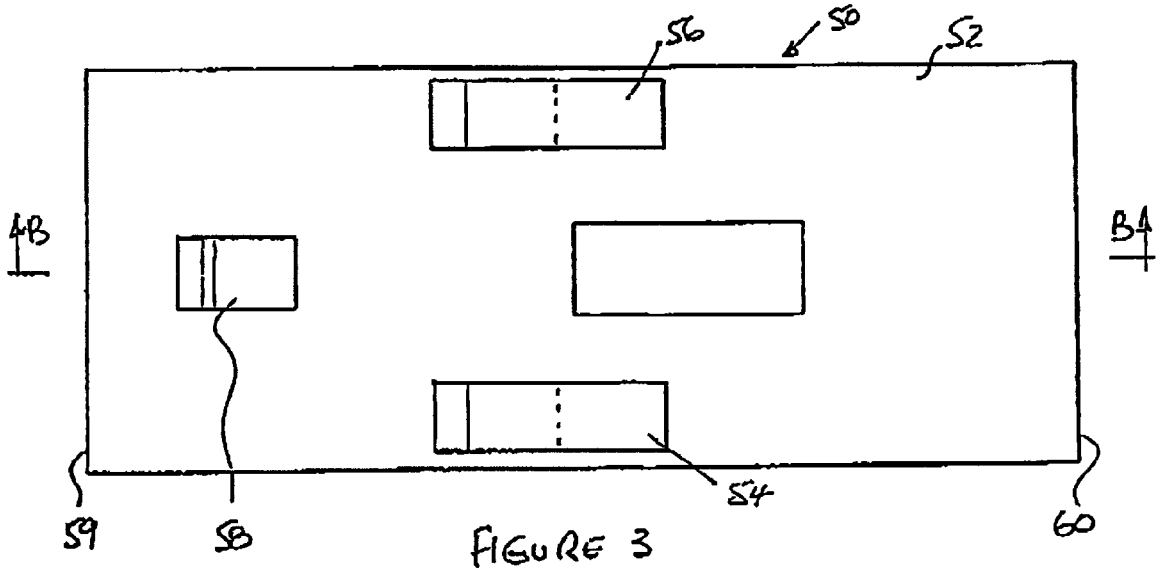
FIGURE 3

FIGURE 6
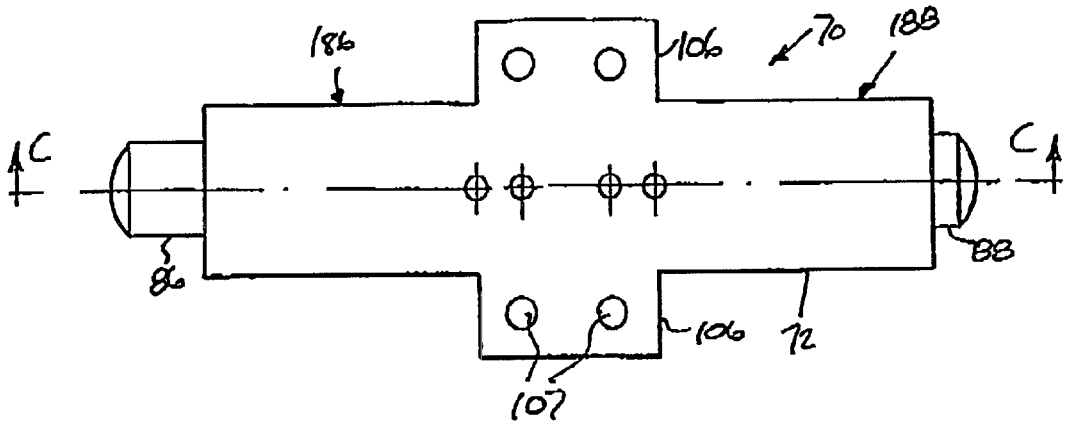
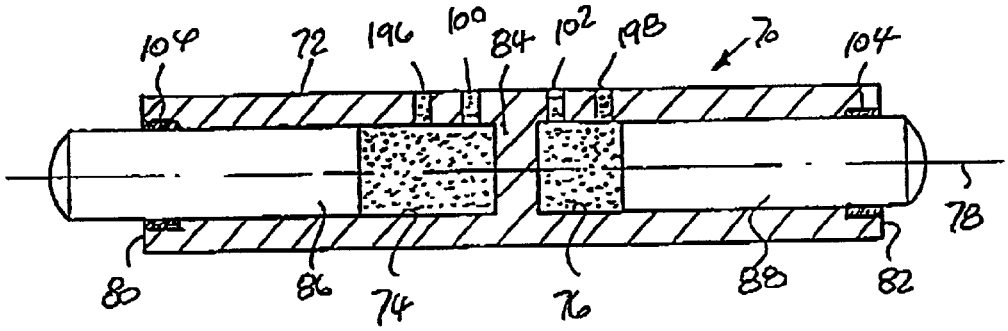
FIGURE 7

CONNECTION APPARATUS

This is a CON of PCT/NZ00/00073 filed May 15, 2000.

TECHNICAL FIELD

This invention relates to connectors for earthmoving implements.

BACKGROUND ART

The specification of New Zealand Patent #220557/222864 discloses a connector for facilitating the mounting and demounting of a variety of earthmoving implements to a vehicle such as a digger or front-end loader. This connector is useful for speeding up the changing of one implement to another. It comprises a body which is mounted on the digger and is provided with two recesses in which respective pins mounted on the implement are received in the process of mounting the implement in the digger. The first of the recesses is provided with a hydraulically operated closure member which retains the first pin in the first recess. The recesses are oriented at right angles to one another and because of this, as long as the first pin is held in the first recess by the closure member, the implement is locked to the connector.

The present applicant is the proprietor of granted New Zealand Patent #250811 which discloses a connector provided with a closure member which is mounted on a plate which is located in the body. The plate is slidable between a working position in which the closure member holds the first pin captive in the first recess and a second position in which the closure member is withdrawn from the first recess so that the first pin can pass out of the first recess. The connector fixer copses a locking pin arranged, for safety, to be inserted in an aperture in the plate and having tapered faces which engage with the outer end of the aperture and the outer face of an end plate of the body to lock the plate in the working position.

It is an object of the present invention to provide a connector incorporating various modifications including a modified safety lock system.

Further aspect and advantages of the present invention will become apparent from the ensuing description that is given by way of example only.

DISCLOSURE OF INVENTION

According to one aspect of the invention, there is provided a connection apparatus for connecting an implement to a prime mover, the apparatus including a body arranged to be mounted on the prime mover and provided with connecting means for connecting the body to the implement, the connecting means including at lest two recesses disposed substantially at right angles to one another within the body, and a locking member, said locking member being adapted to move to a first position, in which the locking member engages the implement to lock the implement and the body together, and said locking member being adapted to move to a second position in which the locking member is disengaged from the implement so that the implement can be demounted from the body.

According to another aspect of the present invention there is provided a connection apparatus, substantially as described above wherein the locking member is carried on a plate which is slidably mounted to the body, the apparatus including a means to move the locking member includes a ram which arranged to move the plate to move the locking member to at least one of said positions.

According to another aspect of the present invention there is provided a connection apparatus substantially as described above wherein the ram is located on the same side of the plate as the locking member.

According to another aspect of the present invention, there is provided a connection apparels substantially as described above wherein the locking member is pivotally mounted to the body and is associated with a plate slidably mounted to the body whereby the means to move the locking member includes a ram adapted to move the plate into contact with the locking member and to pivot the locking member into at least one of said first or second positions.

According to a further aspect of the present invention there is provided apparatus for connecting an implement to a prime mover, the apparatus including a body arranged to be mounted on the prime mover and provided with connecting means for connecting the body to the implement, the connecting means including a locking member and means to move the locking member between a first position in which the locking member engages the implement to lock the implement and the body together, and a second position in which the locking member is disengaged from the implement so that the implement can be demounted from the body, the locking member being carried on a plate which is slidably mounted in the housing, the means to move the locking member including a ram which is located on the same side of the plate as the locking member and is arranged to move the locking member to at least one of said positions.

Reference throughout this specification will also be made to the present invention including a means to move the locking member, preferably in the form of a displacement ram. However, those skilled in the art should appreciate that the present invention does not necessarily require the use of a displacement ram or any type of dedicated means to move the locking member to function effectively. The present invention may be adapted so that a sliding plate associated with the locking member may be moved manually or through the provision of a number of different types of rams to move the locking member, and reference to the use of displacement rams throughout this specification should in no way be seen as limiting. For example, in one embodiment the present invention may be configured as a manually operated apparatus where a sliding plate associated with the locking member may be moved by the invention's operator.

Preferably the present invention includes a means to move the locking member in the form of the displacement ram fixed to the sliding plate mounted in the body. The displacement ram or rams used may be permanently fixed only to the sliding plate but may have an end or ends of the ram placed in contact with sections of the body. In such an embodiment no components of the ram may be directly connected to the body. This configuration of the invention allows it to be used even if the ram connected to the sliding plate fails. If this situation occurs the hydraulic fluid used to drive the ram can simply be drained allowing the plate to be slid manually the invention's operator to mount or demount an implement from the prime mover.

In one form of the invention, the displacement ram is arranged to be extended to move locking member to the first position.

According to one aspect of the invention, the means to move the locking member comprises a second ram arranged to move the locking member to the second position.

According to one aspect of the invention the second ram is a displacement ram.

According to one aspect of the invention the displacement rams are in axial alignment.

According to another aspect of the invention, there is provided a connection apparatus for connecting an implement to a prime mover, the apparatus including a body arranged to be mounted on the prime mover, the apparatus including a connecting means for connecting the body to the implement, the connecting means including a locking member and means to move the locking member between a first position in which the locking member engages the implement to lock the implement and the body together, and a second position in which the locking member is disengaged from the implement so that the implement can be demounted from the body, the means to move the locking member including a first displacement ram arranged to move the locking member to the first position and a second displacement ram arranged to move the locking member to the second position, the displacement rams being joined together in mutual axial alignment.

In one form of the invention, each displacement ram comprises a sliding element which is slidably mounted in a cylinder, the cylinders being disposed so that, when each sliding element moves in the cylinder in which it is mounted to extend the ram, the sliding element moves away from a junction between the two cylinders.

According to one aspect of the invention, there is provided a connection apparatus substantially as described above, wherein the body of the connection apparatus defines a first component, and the connection apparatus includes a second component which is pivotably mounted to the body, said second component being provided with a second connecting means for connecting the connection apparatus to the prime mover, wherein the first component is associated with at least one ram adapted to pivot the first component in relation to the second component.

According to one aspect of the invention, two displacement rams are provided, the first displacement ram being arranged to tilt the first component in one direction and the second displacement being arranged to tilt the first component in the opposite direction.

BRIEF DESCRIPTION OF THE DRAWINGS

Further aspects of the present invention will become apparent from the ensuing description that is given by way of example only and with reference to the accompanying drawings in which:

FIG. 1 is a plan view of the body of a connection apparatus as configured in a preferred embodiment of the present invention, and FIG. 2 is a cross sectional side view of the connector body shown viewed on Arrows A—A in FIG. 1;

FIG. 3 is a plan view from below of a sliding plate assembly of the connector assembly;

FIG. 4 is a cross sectional side view of the sliding plate assembly viewed on Arrows B—B in FIG. 3;

FIG. 6 is a plan view of a double ram assembly of the 'displacement' type;

FIG. 7 is a cross section side view of the rain assembly viewed on Arrows C—C in FIG. 6;

BEST MODES FOR CARRYING OUT THE INVENTION

Figure 5:
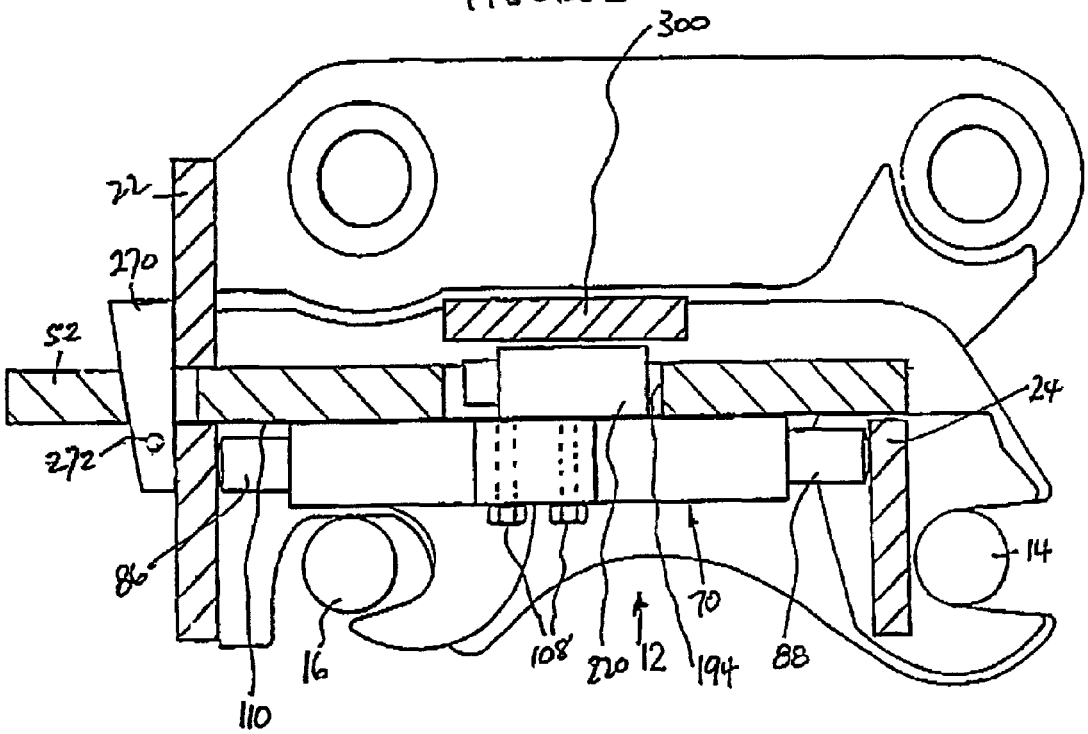
FIG. 5 is a cross sectional side view of the connector assembly showing the sliding plate assembly mounted in its working position on the body.

For the sake of avoiding repetition, in what follows the use of the phrase 'in the present example' or words to the same effect is intended to indicate that what is being described is by way of illustrative example and that the scope of the invention is not intended to be limited thereto unless a contrary intention appears from the context. On the other hand, in the absence of a phrase such as 'in the present example' or words to the same effect, it should not be taken that the scope of the invention is to be limited by any matter described unless it is clear from the context that this is intended.

Referring first to FIGS. 1 to 7, there is shown the body 10 of a connector assembly (indicated at 12 in FIG. 5) for connecting an implement such as a bucket) to a prime mover (such as a digger). Neither the implement nor the prime mover are shown in FIGS. 1 to 7 of the drawings. The general nature and manner of use of the connector assembly 12 will be clear to the instructed reader and it is not considered necessary to describe the implement or the prime mover in detail. However, the implement is provided with two spaced parallel pins by means of which the implement is attached to the connector assembly. For ease of explanation these pins are indicated at 14 and 16 respectively in FIG. 5. The pins are fixed permanently or semi-permanently to the implement and, at least in the present example, do not form part of the connector assembly.

The body 10 comprises two spaced, composite side walls 18, 20 joined at one end by a cross wall 22 and adjacent the other end by a second cross wall 24. The side walls are substantially mutually similar but 'handed'. Only one of them will be described. Each side wall comprises an outer plate 26 joined to an inner plate 28 with an intermediate plate 27 sandwiched there between. The outer plates 26 are located at what for convenience will be referred to as the top of the body. Each outer plate 26 is provided with two spaced holes, 30, 32 through which pass mutually parallel pins, not shown in FIGS. 1 to 5 but indicated at 94 in FIGS. 9 to 12, by means of which the body is ached to the arms of a digger or other prime mover 92. The connector assembly 12 is not normally detached from the prune mover so that these pins 94 remain at least semi-permanently in place in the holes 30, 32. The arms of the prime mover (indicated at 96 in FIGS. 9 to 12) are located between the outer plates 26 of the respective side walls 18, 20.

Reinforcing rings 30', 32' are welded to the side plates 26 around the holes 30, 32. The rings strengthen the plates 26 around the holes and also reduce the rate of wear of the plates 26 around the holes 30, 32. Alternatively, bushes may be inserted in the holes and welded in place.

The inner plate 28 comprises two recesses 34, 36. These recesses are disposed substantially at right angles one to the other so tat the recess 34 opens to one end of the body (this end being the end adjacent which the cross wall 24 is located) and the recess 36 opens to what may conveniently be described as the bottom of the body. The recesses 34, 36 in the respective inner plates 28 are aligned with each other across the body 10 so as to be able to receive the pins 14, 16. The pins 14, 16 enter the respective recesses 34, 36 and are retained therein in a manner which will be described in order to lock the implement on the connector assembly.

As in the case of the holes 30 reinforcing plates 34' are welded to the inner plates 28 around the recesses 34.

The side walls 18, 20 are disposed parallel to each other and welded to the cross wall 22 adjacent parallel side edges 38, 40 of the latter. There is thus a space 42 between the side walls. A rectangular aperture 44 is cut in the cross wall 22. The aperture 44 is parallel to the axis of the pins 14, 16 and spans the space 42.

The second cross wall 24 is disposed parallel to the cross wall 22 and is located closely adjacent the inner ends of the recesses 34 in the respective plates 28. The cross wall 24 is welded to the reinforcing plates 34'.

The cross walls 22, 24, and the outer and inner plates 26, 28 and the intermediate plates 27 are all advantageously comprised of heavy steel plates. All of these components are welded together.

In an alternative construction the body 10 may comprise a steel casting.

Referring now to FIGS. 3 and 4, the sliding plate assembly 50 comprises a flat rectangular base plate 52 which is a sloppy sliding fit between the plates 28 of the body 10. The side walls thus serve as guides for the sliding plate 52. Two substantially identical and mutually parallel locking plates 54, 56 are welded to the plate 52 adjacent the respective longer edges thereof. In the present example, a slot 58 is cut in the sliding plate 52 adjacent an end 59 thereof at which the plate 52 projects slidably through the aperture 44 in the cross wall 22. Adjacent its opposite end 60, the sliding plate 52 bears slidably on the second cross wall 24 of the body. The sliding plate 52 is arranged to slide over the tops of the second cross wall 24 and the reinforcing plates 34' and through the aperture 44 in the body. The plate 52 slides between what will be called an open position and a closed position. Substantially identical hook formations 62 are formed in the locking plates 54, 56. The locking plates, and in particular the hook formations 62, are positioned so that, when the sliding plate is in the open position, the hook formations 62 leave the pin 16 free to move in and out of the recesses 36; and when the sliding plate is in the closed position, the hook formations 62 bear on the pin 16 with a wedging action, holding the pin 16 captive in the recesses 36 and tending to force the pin 16 against the inner faces of the recesses 36. It is advantageous to provide that the inner faces of the hook formations are canted an angle 63 of between 10° and 24° and preferably about 15° to the direction of motion of the sliding plate 52. This prevents the hook formations from jamming against the pin 16 when the sliding plate is in the closed position and also reduces wear of the working faces of the recesses 36 and the book formations 62. At the same time it provides sufficient friction to reduce the tendency for the sliding plate 52 to work loose in use.

An advantage arising from the sloppy fit of the sliding plate 52 between the plates 28 is that the sliding plate can, within limits, skew so that the hook formations 62 align themselves with the pin 16 despite inaccuracies in alignment arising from manufacturing procedures or wear during use. This advantage enables, for example, the locking plates to be cut off by a profile burner rather than machined.

The sliding plate 52 and the locking plates 54, 56 are also preferably fabricated from heavy steel plate and are welded together. Alternatively, as in the case of the body 10, the sliding plate 52 and the locking plates 54, 56 may comprise a casting A ram assembly 70 is provided for moving the sliding plate 52 between the open position and the closed position described above. Referring particularly to FIGS. 6 and 7, the ram assembly 70 comprises a one-piece body 72 which in the present example is of medium carbon steel. Two cylindrical bores 74, 76 of equal diameter are provided in the body 72. The bores 74, 76 are disposed on a common longitudinal axis 78 and open in opposite directions, one bore 74 opening to a face 80 at one end of the body and the other bore 76 opening to a face 82 at the opposite end of the body. At their inner ends the bores are closed by a common cross wall 84. Rods 86, 88 are received in the respective bores 74, 76. In the present example, the rods are equal in length and are longer than the respective bores so that the outer ends of the rods project clear of the faces 80, 82 even when the rods occupy the full depth of the bores. Through ports 100, 102 hydraulic fluid is introduced into the respective bores between the cross wall 84 and the inner ends of the rods 86, 88. Each rod and the bore in which it is received constitutes a displacement type ram assembly 186, 188. The ram assemblies 186, 188 are axially aligned. A ram assembly of the displacement type is characterised in that the rod carries no piston or similar device which is in sealing sliding contact with the wall of the bore. Instead, a seal arrangement is provided between the bore and the rod itself the rod to slide in the bore without allowing any of the fluid to escape. The pressure of the hydraulic fluid acts to drive the rod outwardly from the bore but not in the return direction. Each assembly 186, 188 is by itself similar in principle to conventional displacement rams and it is not considered necessary to describe it in further detail. In the present case the seal arrangements are indicated at 104. Also, in the present example the interfacing parts of the rods and the bores are hardened so that wearing sleeves which are commonly provided in the bores of conventional displacement ram assemblies are dispensed with.

The upper and lower outer faces of the body 72 of the ram assembly 70 are flat. At its longitudinal centre the body has two laterally projecting portions 106 each provided with two holes 107 which accommodate bolts 108 by means of which the body is fixed to the sliding plate 52. The flat faces make the body easy to secure in place. The position of the ram assembly on the sliding plate is selected so that when the sliding plate is located midway between the open position and the closed position as described above, the body 72 is located midway between the cross walls 22, 24. The length of the rods 86, 88 is such that, when the body 72 is fixed in the above mentioned position and the outer ends of the rods are in abutment with the respective cross walls 22, 24 both of the rods occupy about half of the length of the respective bores 74, 76. Thus, due to the fact that the rod 88 is in abutment with the cross wall 24, when the ram 188 is extended the rod 88 drives the gliding saw to that closed position. Similarly, due to the fact that the rod 86 is in abutment with cross wall 22, when the ram 186 is extended, the rod 86 drives the sliding plate to the open position.

The two aligned displacement rams for moving the sliding plate are more compact than a ram of the sane power including a conventional double acting piston and cylinder arrangement. This is due to the fact that the end the cylinder through which the piston rod projects is closed by an end cap which is necessarily bulky both in width and in length in order to withstand the forces which arm applied to it. The fact that the two displacement ram have a common end wall 84 also reduces the length of the ram assembly 70.

A further advantage arising from the diminished size of the displacement ram assembly is that it can be mounted on the face 110 of the sliding plate which is remote from the side at which the connector assembly 12 is joined to the digger 92 by the pins 94. The sliding plate offers a degree of protection to the ram assembly when the digger is in use.

To operate the ram 188, hydraulic fluid is fed to the port 102 by a suitable hydraulic line from a conventional control valve. To move the sliding plate 52 to the closed position, the control valve is moved to a first operating position in which hydraulic fluid under pressure is fed into the ram 188. This drives the rod 88 outwardly in the bore 76. The rod 88 is moved back into the bore 76 by extending the ram 186 as described below, thus driving the sliding plate to the open position. This is achieved by moving the control valve to a second operating position which not only allows hydraulic fluid to be fed to the ram 186 but also allows hydraulic fluid to be exhausted to tank from the ram 188 through the port 102.

A safety valve assembly 220 is interposed between the control valve and the rams 186, 188. The assembly 220 is mounted on the body 72 of the ram assembly and is accommodated in an aperture 194 formed in the sliding plate 52. This safety valve assembly can be a commercially available proprietary product and its construction need thus not be described in detail. However, its method of operation is as follows. When the operator wishes to engage an implement with the connector assembly, he moves the control valve (which is located in the cab of the digger) to the first operating position. This causes hydraulic fluid under pressure to flow via a first check valve in the safety valve assembly 220 to the ram 188. The fluid causes the rod 88 to extend and move the sliding plate 52 to the closed position. However, the check valve functions to prevent the fluid from flowing back out of the ram 188 and the sliding plate is thus locked in the closed position. When the operator wishes to release the implement from the connector assembly, he moves the control valve to the second operating position. This causes the hydraulic fluid to flow to the ram 186. However, the rod 86 is initially prevented from being extended by the ram 188 which, as noted above, cannot retract owing to the action of the check valve. The safety valve assembly is provided with an internal mechanism which is actuated by the pressure of the fluid which flows to the ram 186. When this pressure reaches about 66% of the pressure required to actuate the ram 186, the aforementioned internal mechanism is actuated to disable the check valve. This enables the residual fluid in the ram 188 to flow back to tank and the ram 188 to retract as the ram 186 extends and moves the sliding plate to the open position.

The ram 188 thus locks the sliding plate in the closed position with the pin 16 firmly wedged between the book formations 62 and the inner faces of the recesses 36. A substantial positive pressure must be applied to the fluid which flows to the ram 186 before the ram 188 will release the sliding plate.

In the present example, a suitable safety valve arrangement 220 comprises a pilot to open check valve and cartridge. The valve assembly is supplied under catalogue number HCV 2125 by HCV Ltd of Auckland, New Zealand and the cartridge is supplied under catalogue number CKBD XCN by the Sun Hydraulic Corp of Florida, USA.

A protective plate 300 may be mounted between the plates 28 to cover the safety valve assembly 220.

Additional ports 196, 198 may be provided in the body 72 for the respective bores 74, 76. These ports are semi-permanently closed by screwed plugs. If for any reason the hydraulic system fails, the prepare of the residual fluid in the bores 74, 76 can be released to enable the connector assembly to be manually disconnected from the digger.

As a further safety feature, the sliding plate 52 can be held in the closed position by means of a wedge shaped locking key 270 which passes through the slot 58 and has angled faces which bear respectively on the outer face of the cross wall 22 and the end face of the slot 58. The angle between these faces must be selected so that the tendency for the key to work loose is minimised; at the same time the angle must not be so small that the key is jammed immovably in place. A suitable angle has been found to be between 8° and 12° and preferably about 10°. For safety reasons, a retaining pin may be located in one of the holes 272 in the key to prevent the key from falling out of the slot should it work loose.

An important advantage arising from the possibility of locking the sliding plate in position with the key 270 is that the connector can be safely used when the ram assembly 70 is out of commission for any reason.

The ram assembly 70 could be pneumatically operated instead of hydraulically operated as described.

As an alternative means of locking the sliding plate 52 in the closed position, the safety valve arrangement 220 could be provided with a piston actuated by the pressure of the hydraulic fluid. When the sliding plate moves to the closed position, the piston is arranged through a spring to operate a sliding bolt or other mechanical locking device which locks the sliding plate in the closed position. When hydraulic fluid is fed to the ram 186, the pressure of the hydraulic fluid causes the piston, through the locking device to unlock the sliding plate only.

Figure 8:
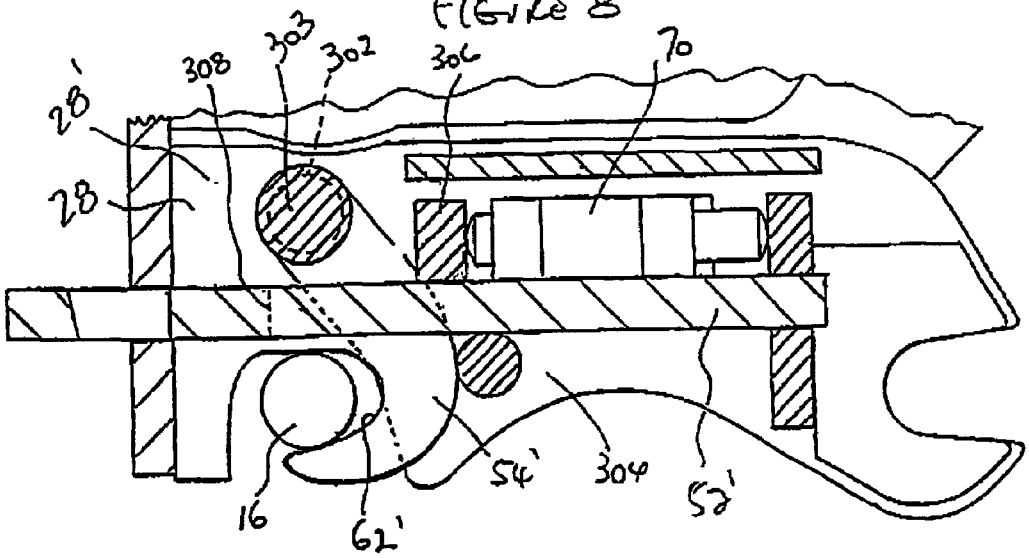
FIG. 8 is a detail of a modified connector assembly.

The invention is not necessarily confined to a connector assembly in which the locking plates are carried on a sliding plate and thus move linearly to engage the pin 16. As shown schematically in FIG. 8, the locking plates (only one of which 54' can be seen in the drawing) are integrally joined together through a hub 303. Spigots 302 are formed at each end of the hub, projecting outwardly from the respective locking plates. These spigots are pivotably mounted in bearing plates 28' which are demountably fixed in recesses in the sides 18, 20 of the body. The locking plates are provided with hook formations 62' which engage the pin 16 with a wedging action (in the same way as already described) as the locking plates pivot about the spigots. In the present example, the sliding plate 52' is positioned below the hub 303 and is provided with recesses along its edges which accommodate the locking plates. The ram assembly 70 is mounted on the upper face of the sliding plate and bears on cross walls 24', 306. A first pair of round bosses 304, welded to the lower face of the sliding plate, bear on the rear faces of the respective locking plates and cause the locking plates to pivot clockwise into engagement with the pin 16 when the sliding plate moves to the closed position. Similarly, the front faces of the recesses in the edges of the sliding plate bear on the front faces of the respective locking plates when the sliding plate moves to the open position. This causes the locking plates to pivot anticlockwise to release the pin 16 from the recesses 36.

Figure 9:
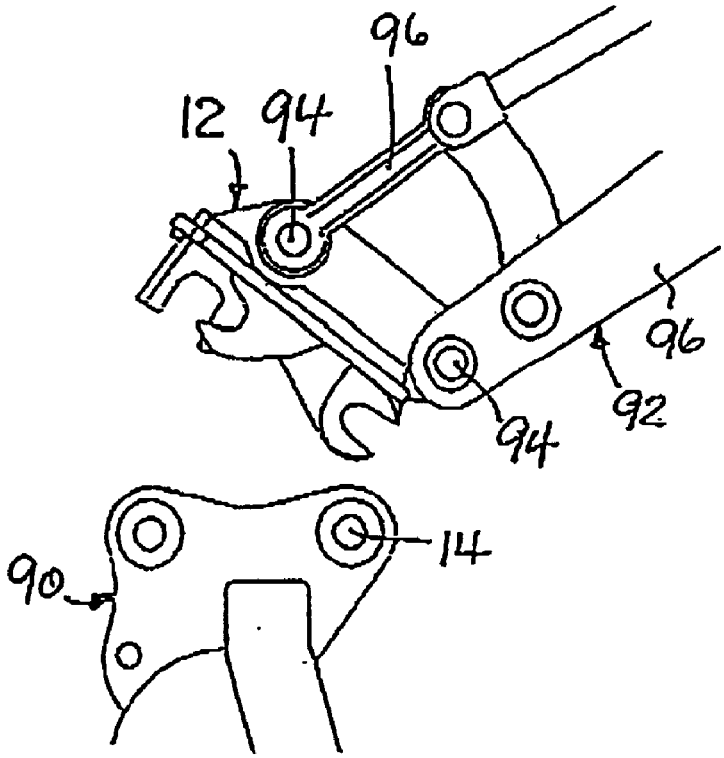
FIGS. 9 to 12 show somewhat schematically four stages in mounting an implement on a prime mover by means of the connector assembly shown in FIGS. 1 to 7.
Figure 10:
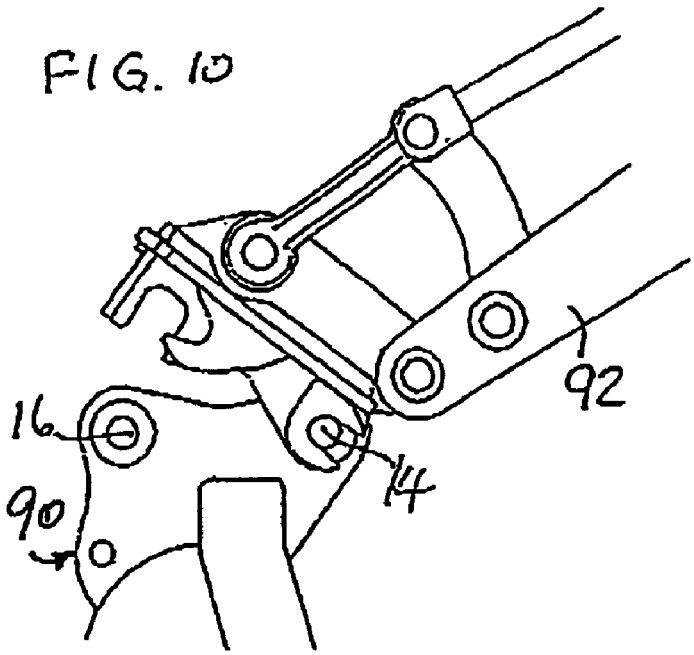
Figure 11:
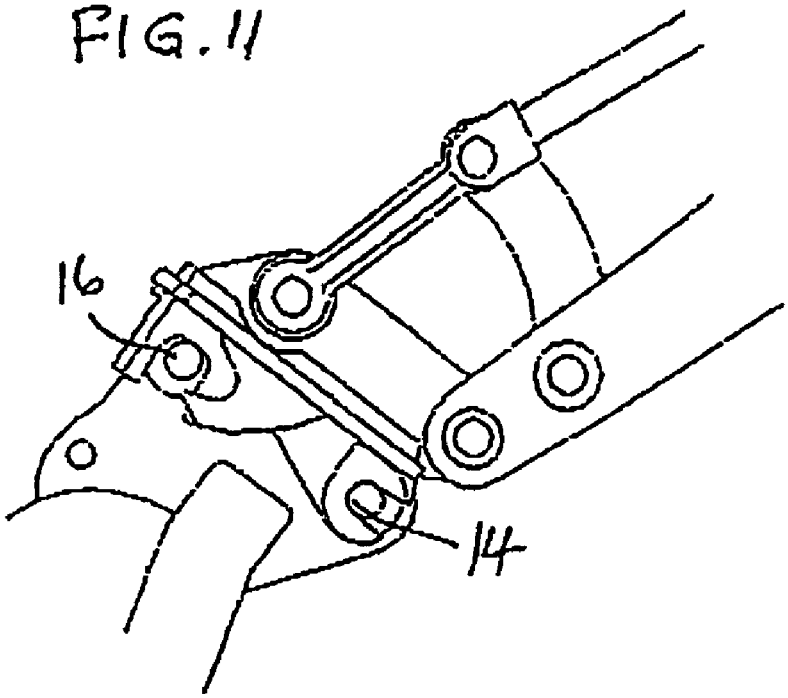
Figure 12:
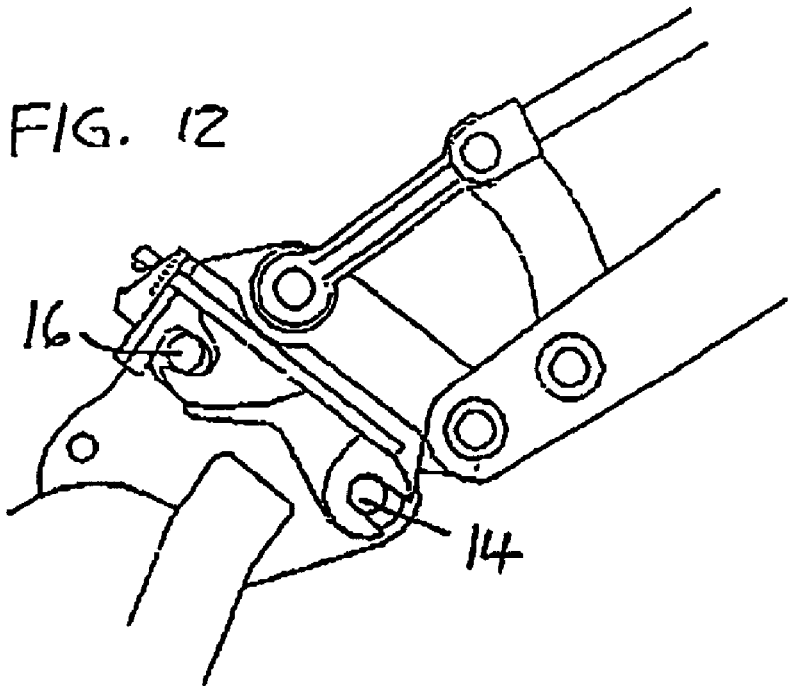

It is believed that FIGS. 9 to 12 will be substantially self-explanatory. In FIG. 9, the connector assembly 12 is shown mounted on the arms 96 of the prime mover 92 and removed from the implement 90. The ram 186 has been extended so that the locking plates 54, 56 do not obstruct the recesses 36. The prime mover manoeuvres the connector assembly so that as a first step the pin 14 on the implement enters the recesses 34. This stage is shown in FIG. 10. With the locking plates in the open position, the connector assembly is pivoted about the pin 14 so that the pin 16 enters the recesses 36, as shown in FIG. 11. The ram 188 now moves the sliding plate 52 to the closed position, locking the pin 16 in the recesses 36. The sliding plate 52 is locked in this position by means of the check valve in the safety valve assembly and also, if necessary, by means of the key 270 as shown in FIG. 12.

Figure 13:
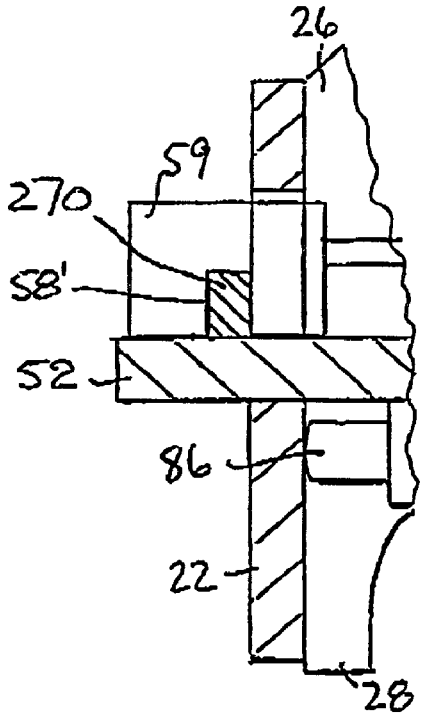
FIG. 13 is a detail of a modification of the connector assembly shown in FIG. 5.

In FIG. 13 the slot 58 is omitted from the sliding plate 52. A lug 59 is welded to or cast integrally with the sliding plate. The lug is located at the forward end of the sliding plate and stands up from the upper face thereof. A slot 58' is formed in the lug and receives the wedge shaped locking key 270. In the present case however, the key 270 is horizontally disposed. This has the advantage that the key is easier to insert in and remove from the slot 58' in some cases.

Figure 14:
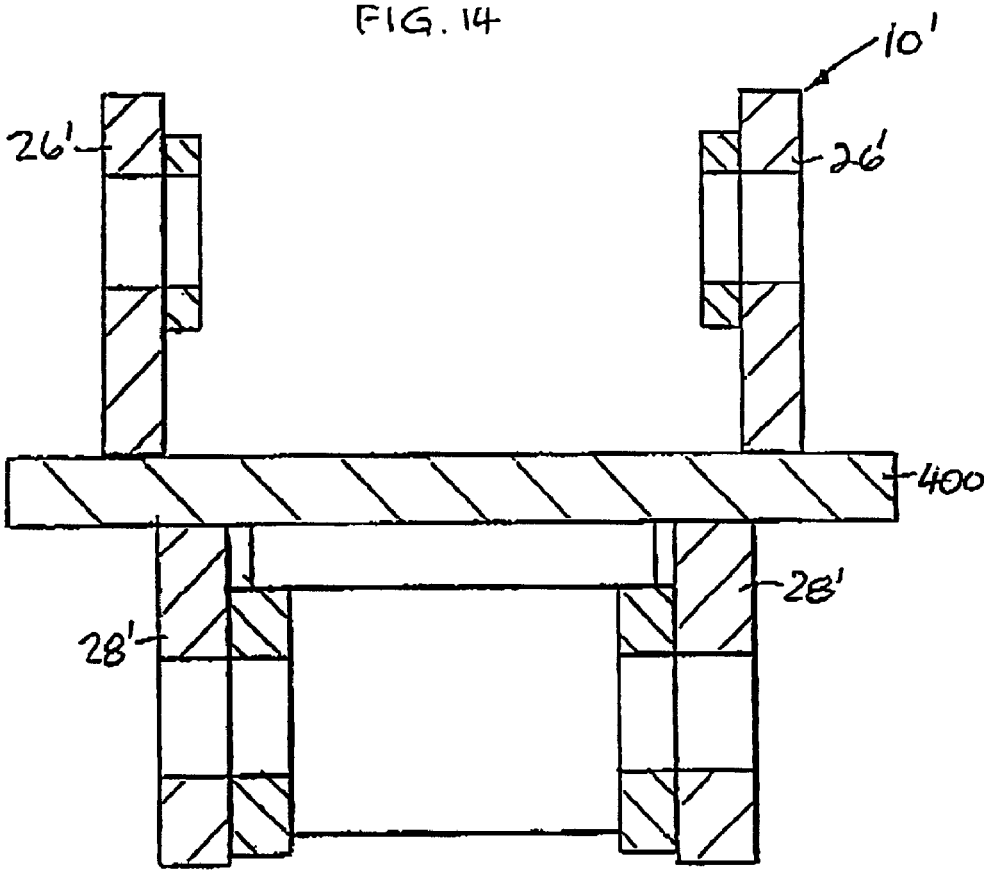
FIG. 14 is an end view of the body of a modified connector assembly.

FIG. 14 illustrates the body 10' of another connector constructed in accordance with the invention. In this case the body 10' comprises inner plates 28'. The plates 28' are joined along their upper edges by a horizontally disposed cross plate 400 which extends for substantially the full length of the body. Below the cross plate 400, the layout and construction of the body 10' is substantially identical to the body 10. A sliding plate, which is not shown in FIG. 14 but which may be substantially identical to the sliding plate 52, is accommodated in the body 10' below the cross plate 400.

The width of the cross plate is greater than the space between the inner plates 28' so that the cross plate 400 overlaps the inner plates along each side. Two plates 26' for joining the connector to the prime mover are mounted on the cross plate 400 adjacent each side thereof. The plates 26' are provided with bushes for receiving the pins 30, 32. The plates 26' stand up from the upper face of the cross plate and, while they may be cast integrally with the cross plate, in the present case, they are advantageously welded thereto. The reason for this is to enable the body 10' to be constructed with the plates 26' being attached thereto as substantially the final manufacturing operation. The body 10' minus the plates 26' but whose dimensions can be chosen to suit an available range of implements, can therefore be manufactured and held in stock. When an order is placed for the connector, it is a relatively quick matter to fabricate the plates 26' and to position them on the cross plate to suit the digger or other prime mover on which the connector is to be mounted. The distance between the plates 26' may be less than the distance between the plates 28.

Figure 15:
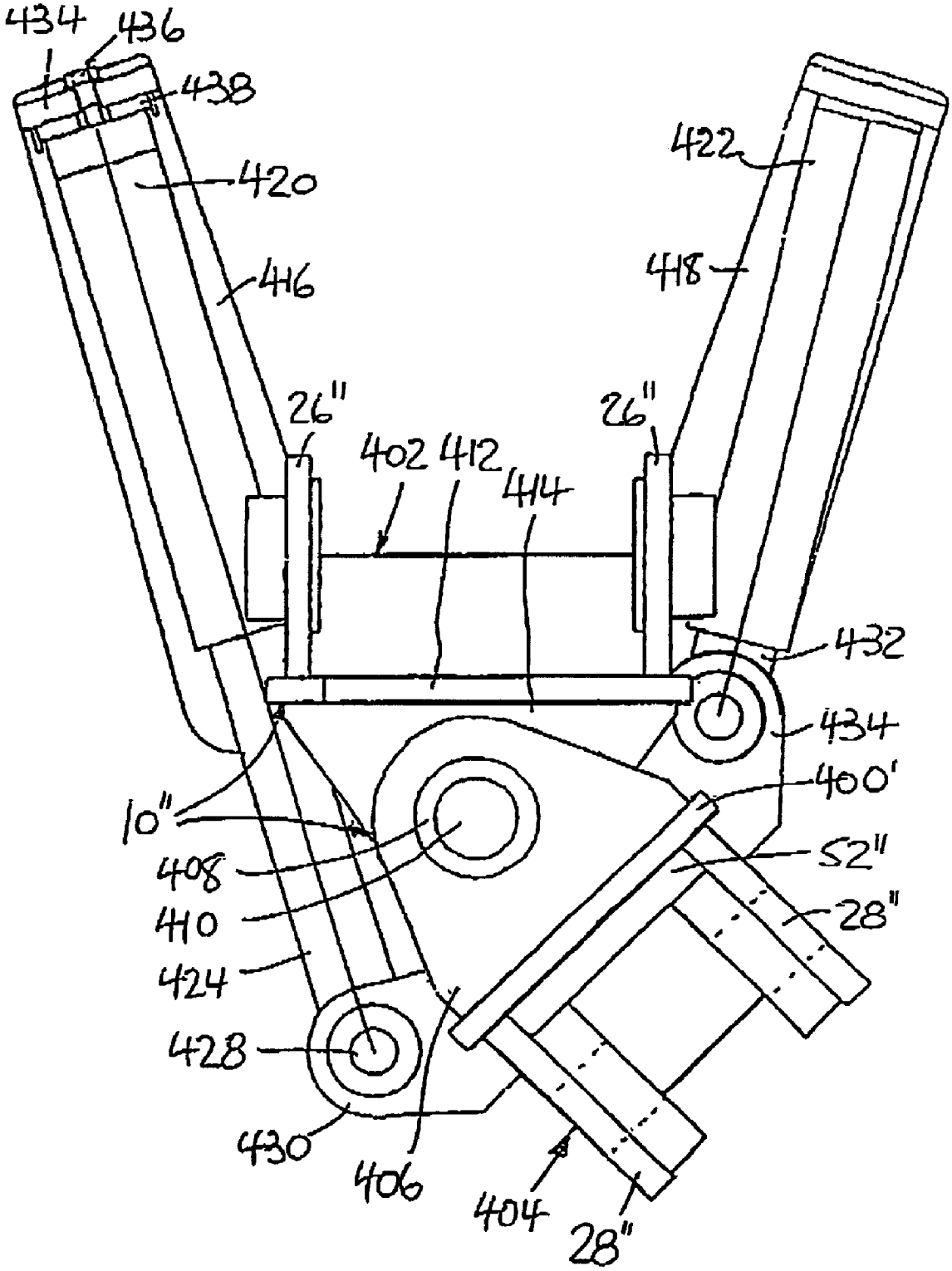
FIG. 15 is an end view of yet another modified connector assembly.

Referring now to FIG. 15, there is shown yet another connector assembly. This assembly comprises a body 10" including an upper component 402 and a lower component 404. The lower component is similar to the body 10' in that it comprises plates 28" connected by a cross plate 400' extending for substantially the full length of the component 404. Below the cross plate 400', the layout and construction of the component 404 is substantially identical to the body 10 although this is not essential. A sliding plate 52" which may be substantially identical to the sliding plate 52, is accommodated in the component 404 below the cross plate 400'. The sliding plate is advantageously actuated by a hydraulic ram which may be a displacement ram but could also be a conventional piston and cylinder type ram.

Two trunnion plates, only one 406 of which can be seen in FIG. 15, are welded to or cast integrally with the cross plate 400'. The trunnion plates stand up from each end of the upper face of the cross plate 400'. Bushes 408 for receiving a pivot pin 410 are welded into aligned holes in the trunnion plates.

The upper component 402 comprises a plate 412 which is similar in size to the cross plate 400'. Two trunnion plates 414 are mounted on the plate 412. The trunnion plates 414 depend from the lower face of the plate 412 adjacent each end thereof. The upper component 402 is pivotably joined to the lower component 404 by means of the pivot pin 410 which passes through bushes mounted in the trunnion plates 414.

Two plates 26" for joining the connector assembly to the prime mover are mounted on the plate 412 adjacent each side thereof. The plates 26" stand up from the upper face of the plate 412 and may be cast integrally therewith or welded thereto. The plates 26" are provided with bushes for receiving the pins 30, 32. The plate 412 carries mounting brackets 416, 418 projecting angularly upwardly from each side. A displacement ram 420, 422 is mounted on each mounting bracket. The rod 424 of the ram 420 is provided with an eye by means of which, through a pin 428, the rod is pivoted to a lug 430 mounted on one side of the plate 400' of the lower component 404. Similarly, the rod 432 of the second ram 422 is pivoted to a lug 434 mounted on the opposite side of the plate 400'.

The rams 420, 422 are connected through suitable hoses (not shown) to the hydraulic system of the prime mover and can be controlled from the cab by the operator.

Actuation of one or other of the rams causes the lower component 404 (and with it the implement to which it is connected) to tilt about the pivot pin 410.

The upper ends of the rams 420, 422 are fixed to the base plates 434 on the respective brackets 416, 418 each by a single bolt 436 which passes through a hole in the base plate and is screwed into the end of the ram. A pad 438 of high quality elastic material such as urethane is inserted between the end of the ram and the base plate, allowing the ram to tilt to some degree with respect to the base plate.

Tiltable connector assemblies have previously been proposed. However, the commercially available assemblies known to the applicant are actuated by conventional double acting piston and cylinder assemblies. The connectors operate in rough conditions and the possibility of damage to the rams is diminished if the rams can be brought closer in to the arms of the prime mover. This is made possible by the use of displacement rams. As noted above, due to the presence of the bulky end cap through which the piston rod passes, the angle between conventional piston and cylinder assemblies is of necessity such that they stand out from the arms of the prime mover much more than in the present case.

It is not intended that the scope of a patent granted in pursuance of the application of which this specification forms a part should exclude modifications of and/or improvements to the embodiments described and/or illustrated herein or known mechanical equivalents of such embodiments which are within the scope of the invention or be limited by details of such embodiments further than is necessary to distinguish the invention from the prior art.

Aspects of the present invention have been described by way of example only and it should be appreciated that modifications and additions may be made thereto without departing from the scope thereof as defined in the appended claims.

What I claim is:

1. A connection apparatus for connecting an implement to a prime mover, the connection apparatus comprising:

a body adapted to be mounted on the prime mover, the body including connection means for connecting the body to the implement, the connection means including at least two recesses disposed substantially at right angles to one another within the body;

a locking member adapted to move to a first position in which the locking member engages the implement to lock the implement and the body together, said locking member being adapted to move to a second position in which the locking member is disengaged from the implement so that the implement can be demounted form the body; and moving means for moving the locking member, wherein said moving means includes a ram mounted on a plate which is slidably mounted to the body, the ram being adapted to move the plate to thereby move the locking member to at least one of said positions;

wherein the locking member is pivotally mounted to the body and is associated with the plate, whereby the moving means is adapted to move the plate into contact with the locking member and to pivot the locking member into at least one of said first or second positions.

2. A connection apparatus for connecting an implement to a prime mover, the apparatus including a body adapted to be mounted on the prime mover, the apparatus including:

connection means for connecting the body to the implement, the connection means including a plate which is slidably mounted to the body, a locking member, and moving means for moving the locking member between a first position in which the locking member engages the implement to lock the implement and the body together and a second position in which the locking member is disengaged from the implement so that the implement can be demounted from the body, said moving means including a ram mounted on the plate, wherein the moving means includes a first displacement ram adapted to move the locking member to the first position, and a second displacement ram adapted to move the locking member to the second position, the displacement rams being joined together in mutual axial alignment.

3. The connection apparatus as claimed in claim 2, wherein the rams each include a sliding element which is slidably mounted in a cylinder, the cylinders being disposed so that when each sliding element moves in the cylinder in which it is mounted to extend the ram, the sliding element moves away from the junction between two cylinders forming the displacement ram.

4. The connection apparatus as claimed in claim 2, wherein the body of the connection apparatus defines a first component, and the connection apparatus includes a second component which is pivotably mounted to the body, said second component being provided with a second connecting means for connecting the connection apparatus to the implement, wherein the first component is associated with at least one ram adapted to pivot the second component m relation to the first component.

5. The connection apparatus as claimed in claim 2, the first component being associated with two rams, wherein a first ram is adapted to pivot the second component in a first direction, and the second ram is adapted to pivot the second component in the opposite direction to the first direction.

* * * * *